US010370814B2

(12) United States Patent
Fu et al.

(10) Patent No.: US 10,370,814 B2
(45) Date of Patent: Aug. 6, 2019

(54) SYSTEM FOR CONSOLIDATING SOFT CLAY BY COMBINED ANODE BOOSTING AND ELECTRO-OSMOSIS AND METHOD FOR CONSOLIDATING SOFT CLAY

(71) Applicant: WENZHOU UNIVERSITY, Wenzhou, Zhejiang Province (CN)

(72) Inventors: Hongtao Fu, Wenzhou (CN); Jun Wang, Wenzhou (CN); Yuanqiang Cai, Wenzhou (CN); Huanhuan Qiao, Wenzhou (CN); Yawei Jin, Wenzhou (CN); Peng Wang, Wenzhou (CN); Junfeng Ni, Wenzhou (CN); Ziquan Fang, Wenzhou (CN); Jinqiang Jin, Wenzhou (CN); Youchang Lv, Wenzhou (CN); Haisheng Jin, Wenzhou (CN); Changchen Zhou, Wenzhou (CN)

(73) Assignee: WENZHOU UNIVERSITY, Wenzhou (CN)

( * ) Notice: Subject to any disclaimer, the term of this patent is extended or adjusted under 35 U.S.C. 154(b) by 0 days.

(21) Appl. No.: 15/713,393

(22) Filed: Sep. 22, 2017

(65) Prior Publication Data

US 2018/0340309 A1 Nov. 29, 2018

(30) Foreign Application Priority Data

May 23, 2017 (CN) ..... 2017 1 0367162

(51) Int. Cl.
*E02D 3/11* (2006.01)
*E02D 3/12* (2006.01)

(52) U.S. Cl.
CPC . *E02D 3/11* (2013.01); *E02D 3/12* (2013.01)

(58) Field of Classification Search
CPC ..... E02D 3/11; E02D 3/12
See application file for complete search history.

(56) References Cited

U.S. PATENT DOCUMENTS 3,893,303 A * 7/1975 Rotter ..... C09K 8/56 299/11
4,960,524 A * 10/1990 Inculet ..... B03C 5/005 204/513

(Continued)

*Primary Examiner* — Benjamin F Fiorello
(74) *Attorney, Agent, or Firm* — Jiwen Chen

(57) ABSTRACT

The present invention discloses a system for consolidating soft clay by combined anode boosting and electro-osmosis, comprising a vacuum preloading system, wherein the vacuum preloading system comprises anode tubes, cathode tubes, a power supply, a boosting device, sealing cloth and a pumping and drainage device; the sealing cloth is covered above soft clay; air vents are formed on side faces of the cathode tubes and the anode tubes; the cathode tubes and the anode tubes are connected to a boosted pumping and drainage pipe above the soft clay through pipelines; the boosted pumping and drainage pipe is configured with the boosting device and the pumping and drainage device; and, the anode tubes and the cathode tubes are connected to an anode and a cathode of the power supply, respectively. The present invention further provides a method for consolidating soft clay by using the system for consolidating soft clay by combined anode boosting and electro-osmosis. In the present invention, after the anode tubes are configured with a boosting device, a gas can be fed into the anode tubes; under the combined action of the high-pressure gas and the anode tubes, water is squeezed to the cathode tubes, so that water can be drained from the soil more thoroughly.

16 Claims, 1 Drawing Sheet

(56) References Cited

U.S. PATENT DOCUMENTS

| | | | | | |
|---|---|---|---|---|---|
| 5,584,980 | A * | 12/1996 | Griffith | B01D 61/56 | 204/515 |
| 5,616,235 | A * | 4/1997 | Acar | C09K 17/00 | 204/450 |
| 5,656,239 | A * | 8/1997 | Stegemeier | B09C 1/005 | 422/22 |
| 5,976,348 | A * | 11/1999 | Pugh | B09C 1/085 | 204/515 |
| 6,089,788 | A * | 7/2000 | Sandanasamy | E02D 3/10 | 405/258.1 |
| 6,308,135 | B1 * | 10/2001 | Hocking | E02D 3/11 | 367/60 |
| 2004/0228689 | A1 * | 11/2004 | Stegemeier | B09C 1/00 | 405/128.35 |
| 2007/0267355 | A1 * | 11/2007 | Jones | B01D 35/06 | 204/518 |
| 2012/0255872 | A1 * | 10/2012 | Smith | C02F 1/52 | 205/742 |
| 2014/0131206 | A1 * | 5/2014 | Yazdanbod | B01D 61/427 | 204/518 |

* cited by examiner

SYSTEM FOR CONSOLIDATING SOFT CLAY BY COMBINED ANODE BOOSTING AND ELECTRO-OSMOSIS AND METHOD FOR CONSOLIDATING SOFT CLAY

This application claims the priority benefit of Chinese Application No. 201710367162.2 filed May 30, 2017, which is hereby incorporated by reference.

TECHNICAL FIELD OF THE INVENTION

The present invention relates to a system for consolidating soft clay by combined anode boosting and electro-osmosis. The present invention further relates to a method for consolidating soft clay by using the system for consolidating soft clay by combined anode boosting and electro-osmosis.

BACKGROUND OF THE INVENTION

Conventional water drainage from soil and soil consolidation are generally realized by vacuum preloading. To enhance the pumping and drainage effect, there are two treatment approaches. In the first approach, cathode tubes, anode tubes and a power supply are additionally provided in a vacuum preloading system to form a combined vacuum preloading and electro-osmosis drainage system. In the second approach, a boosting device is connected in pipelines of the vacuum preloading system, and the boosting device can provide boosting effect to the soil after preliminary pumping and drainage so that water around a boosting pipe is gathered to the surrounding of a drain pipe and water in the soil is drained more completely.

SUMMARY OF THE INVENTION

In view of the deficiencies in the art, a technical problem to be solved by the present invention is to provide a system for consolidating soft clay by combined anode boosting and electro-osmosis, which can more thoroughly discharge water in the soil and has a higher pumping and drainage efficiency. The technical problem to be solved by the present invention is to further provide a method for consolidating soft clay by using the system for consolidating soft clay by combined anode boosting and electro-osmosis.

Hence, the present invention provides a system for consolidating soft clay by combined anode boosting and electro-osmosis, comprising a vacuum preloading system, wherein the vacuum preloading system comprises anode tubes, cathode tubes, a power supply, a boosting device, sealing cloth and a pumping and drainage device; the sealing cloth is covered above soft clay; air vents are formed on side faces of the cathode tubes and the anode tubes; the cathode tubes and the anode tubes are connected to a boosted pumping and drainage pipe above the soft clay through pipelines; the boosted pumping and drainage pipe is configured with the boosting device and the pumping and drainage device; and, the anode tubes and the cathode tubes are connected to an anode and a cathode of the power supply, respectively.

The present invention further provides a method for consolidating soft clay by using the system for consolidating soft clay by combined anode boosting and electro-osmosis, comprising the following steps of:

A. arranging anode tubes and cathode tubes in a vacuum preloading tank, connecting the anode tubes and the cathode tubes to a boosting device and a pumping and drainage device through the pipelines, and electrically connecting the anode tubes and the cathode tubes to a power supply through an automatic power supply switching system;

B. feeding soft clay slurry into the vacuum preloading tank;

C. covering sealing cloth over the soft clay slurry layer;

D. switching a reversing valve to a state in which the pumping and drainage device is connected to the pipelines, and activating the pumping and drainage device connected to the cathode tubes and the anode tubes to preliminarily drain water;

E. turning on the power supply to connect the cathode tubes and the anode tubes, opening the pumping and drainage device connected to the cathode tubes, and closing the pumping and drainage device connected to the anode tubes so that water is gathered toward the cathode tubes and then drained;

F. switching the reversing valve at one end of the anode tubes to a state in which the boosting device is connected to the pipelines, and activating the boosting device connected to the anode tubes;

G. activating the automatic power supply switching system to exchange the cathode tubes and the anode tubes, opening the pumping and drainage device connected to the anode tubes, and closing the pumping and drainage device connected to the cathode tube so that water is gathered toward the anode tubes and then drained; and H. switching the reversing valve at one end of the cathode tubes to a state in which the boosting device is connected to the pipelines, and activating the boosting device connected to the cathode tubes.

The present invention has the following beneficial effects: in the present invention, after the anode tubes are configured with a boosting device, a gas can be fed into the anode tubes; under the combined action of the high-pressure gas and the anode tubes, water is squeezed to the cathode tubes, so that water can be drained from soil more thoroughly. Moreover, in the method for consolidating soft clay provided by the present invention, by automatically switching the cathode tubes and the anode tubes by an automatic power supply switching system, and by connecting pipelines connected to the cathode tubes or the anode tubes to a boosting device or a pumping and drainage device by the switchover of the reversing valve, the conductive tubes, which are originally anode tubes connected to the boosting device, are changed into cathode tubes connected to the pumping and drainage device by the power conversion and the switchover of the reversing valve, and the conductive tubes, which are originally cathode tubes connected to the pumping and drainage device, are changed into anode tubes connected to the boosting device by the power conversion and the switchover of the reversing valve. Accordingly, water in a region, from which water is not completely pumped and drained due to the pressurization and the connection of the anode, is completely pumped and drained, and the pumping and drainage efficiency is improved by this switchover.

DETAILED DESCRIPTION OF THE INVENTION

Figure 1:
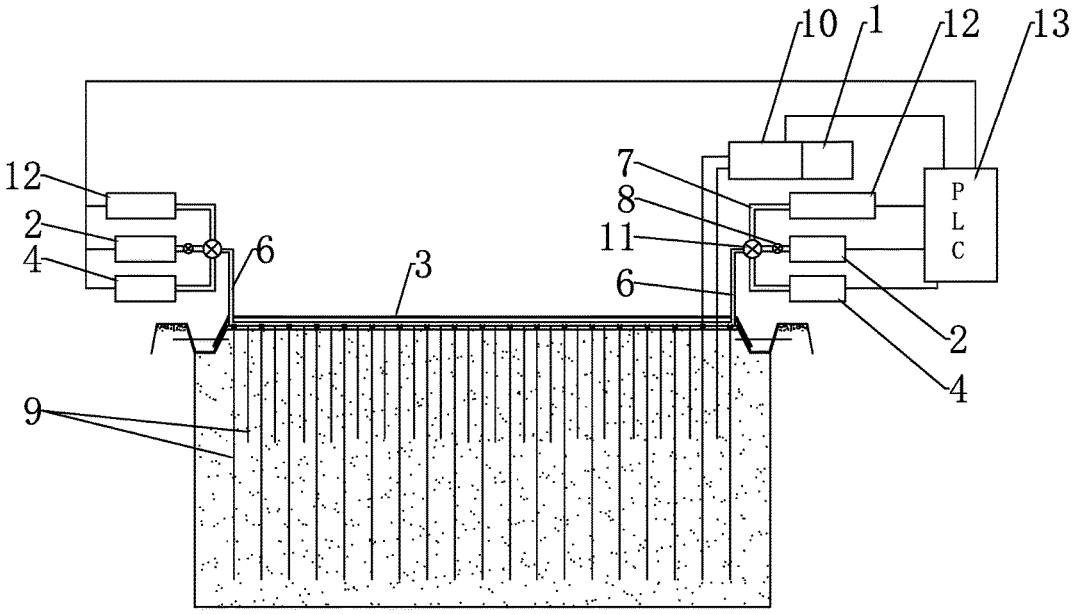
FIG. 1 shows a system for consolidating soft clay by combined anode boosting and electro-osmosis according to the present invention.
Figure 2:
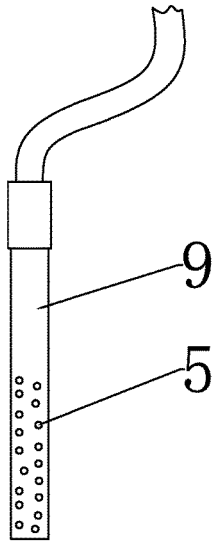
FIG. 2 is a structural diagram of conductive tubes in FIG. 1.

Referring to FIGS. 1 and 2, the present invention provides a system for consolidating soft clay by combined anode boosting and electro-osmosis, comprising a vacuum preloading system. The vacuum preloading system comprises anode tubes, cathode tubes, a power supply 1, a boosting device 2, sealing cloth 3 and a pumping and drainage device 4, wherein the anode tubes and the cathode tubes are interlaced at intervals; the sealing cloth 3 is covered above soft clay 4; air vents 5 are formed on side faces of the cathode tubes and the anode tubes; the cathode tubes and the anode tubes are connected to a boosted pumping and drainage pipe above the soft clay 4 through pipelines 6; the boosted pumping and drainage pipe is configured with the boosting device 2 and the pumping and drainage device 4; and, the anode tubes and the cathode tubes are connected to an anode and a cathode of the power supply 1, respectively. In this embodiment, to maintain the boosted air pressure, one-way valves 8 are provided on conduits 7 from the pipelines of the anode tubes and the cathode tubes to the boosting device, and the one-way valves 8 are turned-on in a single direction downward. The one-way valves 8 may prevent upward gas leakage from the pipelines, so that a high air pressure may be maintained.

Referring to FIGS. 1 and 2, based on the above embodiment, to realize the switchover between the anode tubes and the cathode tubes, both the cathode tubes and the anode tubes are conductive tubes 9 which are generally made of metal; and the conductive tubes 9 are connected to the power supply 1 through an automatic power supply switching system 10 capable of automatically switching the anode and the cathode. In the actual structure, the conductive tubes 9 become anode tubes when being connected to the anode of the power supply, and the conductive tubes 9 become cathode tubes when being connected to the cathode of the power supply. The boosting device 2 and the pumping and drainage device 4 are connected at an upper outlet of each of the conductive tubes 9 through pipelines 6. Both the boosting device 2 and the pumping and drainage device 4 are connected to the pipelines 6 through a reversing valve 11. The reversing valve 11 is provided with an actuator. The boosting device 2, the pumping and drainage device 4 and the actuator are all connected to a PLC (programmable logic controller).

Referring to FIG. 1, to enable a flocculant to be organically integrated into the system for consolidating soft clay, the vacuum preloading system further comprises a flocculant delivery device 12 which is connected to the PLC 13 and connected to the pipelines 6 through the reversing valve 11.

Referring to FIGS. 1 and 2, the present invention further provides a method for consolidating soft clay by using the system for consolidating soft clay by combined anode boosting and electro-osmosis, comprising the following steps of:

A. arranging anode tubes and cathode tubes in a vacuum preloading tank, connecting the anode tubes and the cathode tubes to a boosting device 2 and a pumping and drainage device 4 through the pipelines, and electrically connecting the anode tubes and the cathode tubes to a power supply 1 through an automatic power supply switching system 10;

B. feeding soft clay slurry into the vacuum preloading tank;

C. covering sealing cloth 3 over the soft clay 4 slurry layer;

D. switching a reversing valve 11 to a state in which the pumping and drainage device 4 is connected to the pipelines 6, and activating the pumping and drainage device 4 connected to the cathode tubes and the anode tubes to preliminarily drain water;

E. turning on the power supply 1 to connect the cathode tubes and the anode tubes, opening the pumping and drainage device 4 connected to the cathode tubes, and closing the pumping and drainage device 4 connected to the anode tubes so that water is gathered toward the cathode tubes and then drained;

F. switching the reversing valve 11 at one end of the anode tubes to a state in which the boosting device 2 is connected to the pipelines 6, and activating the boosting device 2 connected to the anode tubes;

G. activating the automatic power supply switching system 10 to exchange the cathode tubes and the anode tubes, opening the pumping and drainage device 4 connected to the anode tubes, and closing the pumping and drainage device 4 connected to the cathode tube so that water is gathered toward the anode tubes and then drained; and;

H. switching the reversing valve 11 connected at one end of the cathode tubes to a state in which the boosting device 2 is connected to the pipelines 6, and activating the boosting device 2 connected to the cathode tubes, wherein only one of the pumping device 4, the boosting device 2 and a flocculant delivery device 12 is connected to the pipelines 6 through the reversing valve 11.

Referring to FIG. 1, in the method, the vacuum preloading system further comprises a flocculant delivery device 12 which is connected to a PLC 13 and connected to the pipelines 6 through the reversing valve 11. Before the step E, the reversing valve 11 is switched to a state in which the pipelines 6 are connected to the flocculant delivery device 12, and the flocculant delivery device 12 is then activated to deliver a flocculant to the cathode tubes and the anode tubes. By feeding the flocculant, the pumping and drainage efficiency may be improved.

Referring to FIG. 1, the method comprises a step I after the step H. In the step I, the reversing valve 11 is switched to a state in which the pipelines 6 are connected to the flocculant delivery device 12, and the flocculant delivery device 12 is activated to deliver the flocculant to the cathode tubes and the anode tubes; then, the reversing valve 11 is switched to a state in which the pipelines 6 are connected to the boosting device 2, and the boosting device 2 is activated to push the flocculant into a deeper position in the soil; and finally, the reversing valve 11 is switched to a state in which the pipelines 6 are connected to the pumping and drainage device 4, and the pumping and drainage device 4 is activated for pumping and drainage. With this step, after the flocculant is fed into the soil, the flocculant may be pushed into a deeper position in the soil by boosting through the booting device 2. As a result, better flocculation effect is obtained, and the pumping and drainage effect is further improved.

The invention claimed is:

1. A system for consolidating soft clay by combined anode boosting and electro-osmosis, comprising a vacuum preloading system, characterized in that the vacuum preloading system comprises anode tubes, cathode tubes, a power supply, a boosting device, sealing cloth and a pumping and drainage device; the sealing cloth is covered above soft clay; air vents are formed on side faces of the cathode tubes and the anode tubes; the cathode tubes and the anode tubes are connected to a boosted pumping and drainage pipe above the soft clay through pipelines; the boosted pumping and drainage pipe is configured with the boosting device and the pumping and drainage device; and, the anode tubes and the cathode tubes are connected to an anode and a cathode of the power supply, respectively, characterized in that one-way valves are provided on conduits from the pipelines of the anode tubes and the cathode tubes to the boosting device, and the one-way valves are turned-on in a single direction downward.

2. The system for consolidating soft clay by combined anode boosting and electro-osmosis according to claim 1, characterized in that the anode tubes and the cathode tubes are interlaced at intervals.

3. The system for consolidating soft clay by combined anode boosting and electro-osmosis according to claim 1, characterized in that both the cathode tubes and the anode tubes are conductive tubes; the conductive tubes are connected to the power supply through an automatic power supply switching system capable of automatically switching the anode and the cathode; the boosting device and the pumping and drainage device are connected at an upper outlet of each of the conductive tubes through pipelines; both the boosting device and the pumping and drainage device are connected to the pipelines through a reversing valve; the reversing valve is provided with an actuator; and, all the boosting device, the pumping and drainage device and the actuator are connected to a PLC (programmable logic controller).

4. The system for consolidating soft clay by combined anode boosting and electro-osmosis according to claim 3, characterized in that the vacuum preloading system further comprises a flocculant delivery device which is connected to the PLC and connected to the pipelines through the reversing valve.

5. The system for consolidating soft clay by combined anode boosting and electro-osmosis according to claim 3, characterized in that the anode tubes and the cathode tubes are interlaced at intervals.

6. The system for consolidating soft clay by combined anode boosting and electro-osmosis according to claim 1, characterized in that the vacuum preloading system further comprises a flocculant delivery device which is connected to a PLC and connected to the pipelines through a reversing valve.

7. A system for consolidating soft clay by combined anode boosting and electro-osmosis, comprising a vacuum preloading system, characterized in that the vacuum preloading system comprises anode tubes, cathode tubes, a power supply, a boosting device, sealing cloth and a pumping and drainage device; the sealing cloth is covered above soft clay; air vents are formed on side faces of the cathode tubes and the anode tubes; the cathode tubes and the anode tubes are connected to a boosted pumping and drainage pipe above the soft clay through pipelines; the boosted pumping and drainage pipe is configured with the boosting device and the pumping and drainage device; and, the anode tubes and the cathode tubes are connected to an anode and a cathode of the power supply, respectively, characterized in that both the cathode tubes and the anode tubes are conductive tubes; the conductive tubes are connected to the power supply through an automatic power supply switching system capable of automatically switching the anode and the cathode; the boosting device and the pumping and drainage device are connected at an upper outlet of each of the conductive tubes through pipelines; both the boosting device and the pumping and drainage device are connected to the pipelines through a reversing valve; the reversing valve is provided with an actuator; and, all the boosting device, the pumping and drainage device and the actuator are connected to a PLC (programmable logic controller).

8. The system for consolidating soft clay by combined anode boosting and electro-osmosis according to claim 7, characterized in that the vacuum preloading system further comprises a flocculant delivery device which is connected to the PLC and connected to the pipelines through the reversing valve.

9. The system for consolidating soft clay by combined anode boosting and electro-osmosis according to claim 7, characterized in that the anode tubes and the cathode tubes are interlaced at intervals.

10. A system for consolidating soft clay by combined anode boosting and electro-osmosis, comprising a vacuum preloading system, characterized in that the vacuum preloading system comprises anode tubes, cathode tubes, a power supply, a boosting device, sealing cloth and a pumping and drainage device; the sealing cloth is covered above soft clay; air vents are formed on side faces of the cathode tubes and the anode tubes; the cathode tubes and the anode tubes are connected to a boosted pumping and drainage pipe above the soft clay through pipelines; the boosted pumping and drainage pipe is configured with the boosting device and the pumping and drainage device; and, the anode tubes and the cathode tubes are connected to an anode and a cathode of the power supply, respectively, characterized in that the vacuum preloading system further comprises a flocculant delivery device which is connected to a PLC and connected to the pipelines through a reversing valve.

11. A method for consolidating soft clay by using the system for consolidating soft clay by combined anode boosting and electro-osmosis according to claim 7, comprising the following steps of:

A. arranging anode tubes and cathode tubes in a vacuum preloading tank, connecting the anode tubes and the cathode tubes to a boosting device and a pumping and drainage device through the pipelines, and electrically connecting the anode tubes and the cathode tubes to a power supply through an automatic power supply switching system;

B. feeding soft clay slurry into the vacuum preloading tank;

C. covering sealing cloth over the soft clay slurry layer;

D. switching a reversing valve to a state in which the pumping and drainage device is connected to the pipelines, and activating the pumping and drainage device connected to the cathode tubes and the anode tubes to preliminarily drain water;

E. turning on the power supply to connect the cathode tubes and the anode tubes, opening the pumping and drainage device connected to the cathode tubes, and closing the pumping and drainage device connected to the anode tubes so that water is gathered toward the cathode tubes and then drained;

F. switching the reversing valve at one end of the anode tubes to a state in which the boosting device is connected to the pipelines, and activating the boosting device connected to the anode tubes;

G. activating the automatic power supply switching system to exchange the cathode tubes and the anode tubes, opening the pumping and drainage device connected to the anode tubes, and closing the pumping and drainage device connected to the cathode tube so that water is gathered toward the anode tubes and then drained; and H. switching the reversing valve at one end of the cathode tubes to a state in which the boosting device is connected to the pipelines, and activating the boosting device connected to the cathode tubes.

12. The method for consolidating soft clay by using the system for consolidating soft clay by combined anode boosting and electro-osmosis according to claim 11, characterized in that the vacuum preloading system further comprises a flocculant delivery device which is connected to a PLC and connected to the pipelines through the reversing valve; before the step E, the reversing valve is switched to a state in which the pipelines are connected to the flocculant delivery device, and the flocculant delivery device is then activated to deliver a flocculant to the cathode tubes and the anode tubes.

13. The method for consolidating soft clay by using the system for consolidating soft clay by combined anode boosting and electro-osmosis according to claim 12, characterized in that the method comprises a step I after the step H; and, in the step I, the reversing valve is switched to a state in which the pipelines are connected to the flocculant delivery device, and the flocculant delivery device is activated to deliver the flocculant to the cathode tubes and the anode tubes; then, the reversing valve is switched to a state in which the pipelines are connected to the boosting device, and the boosting device is activated to push the flocculant into a deeper position in the soil; and finally, the reversing valve is switched to a state in which the pipelines are connected to the pumping and drainage device, and the pumping and drainage device is activated for pumping and drainage.

14. A method for consolidating soft clay by using the system for consolidating soft clay by combined anode boosting and electro-osmosis according to claim 3, comprising the following steps of:

A. arranging anode tubes and cathode tubes in a vacuum preloading tank, connecting the anode tubes and the cathode tubes to a boosting device and a pumping and drainage device through the pipelines, and electrically connecting the anode tubes and the cathode tubes to a power supply through an automatic power supply switching system;

B. feeding soft clay slurry into the vacuum preloading tank;

C. covering sealing cloth over the soft clay slurry layer;

D. switching a reversing valve to a state in which the pumping and drainage device is connected to the pipelines, and activating the pumping and drainage device connected to the cathode tubes and the anode tubes to preliminarily drain water;

E. turning on the power supply to connect the cathode tubes and the anode tubes, opening the pumping and drainage device connected to the cathode tubes, and closing the pumping and drainage device connected to the anode tubes so that water is gathered toward the cathode tubes and then drained;

F. switching the reversing valve at one end of the anode tubes to a state in which the boosting device is connected to the pipelines, and activating the boosting device connected to the anode tubes;

G. activating the automatic power supply switching system to exchange the cathode tubes and the anode tubes, opening the pumping and drainage device connected to the anode tubes, and closing the pumping and drainage device connected to the cathode tube so that water is gathered toward the anode tubes and then drained; and H. switching the reversing valve at one end of the cathode tubes to a state in which the boosting device is connected to the pipelines, and activating the boosting device connected to the cathode tubes.

15. The method for consolidating soft clay by using the system for consolidating soft clay by combined anode boosting and electro-osmosis according to claim 14, characterized in that the vacuum preloading system further comprises a flocculant delivery device which is connected to a PLC and connected to the pipelines through the reversing valve; before the step E, the reversing valve is switched to a state in which the pipelines are connected to the flocculant delivery device, and the flocculant delivery device is then activated to deliver a flocculant to the cathode tubes and the anode tubes.

16. The method for consolidating soft clay by using the system for consolidating soft clay by combined anode boosting and electro-osmosis according to claim 15, characterized in that the method comprises a step I after the step H; and, in the step I, the reversing valve is switched to a state in which the pipelines are connected to the flocculant delivery device, and the flocculant delivery device is activated to deliver the flocculant to the cathode tubes and the anode tubes; then, the reversing valve is switched to a state in which the pipelines are connected to the boosting device, and the boosting device is activated to push the flocculant into a deeper position in the soil; and finally, the reversing valve is switched to a state in which the pipelines are connected to the pumping and drainage device, and the pumping and drainage device is activated for pumping and drainage.

* * * * *